US005720867A

United States Patent [19]

Anastasijevic et al.

[11] Patent Number: 5,720,867

[45] Date of Patent: Feb. 24, 1998

[54] PROCESS FOR THE ELECTROCHEMICAL RECOVERY OF THE METALS COPPER, ZINC, LEAD, NICKEL OR COBALT

[75] Inventors: Nikola Anastasijevic, Schöneck; Gerhard Jedlicka, Kelkheim; Karl Lohrberg, Heusenstamm, all of Germany

[73] Assignee: Metallgesellschaft AG, Frankfurt am Main, Germany

[21] Appl. No.: 549,014

[22] Filed: Oct. 27, 1995

[30] Foreign Application Priority Data

Oct. 29, 1994 [DE] Germany ..... 44 38 692.3

[51] Int. Cl.[6] ..... C25D 21/06; C25D 21/18; C25D 15/00; C25D 9/00

[52] U.S. Cl. ..... 205/98; 205/101; 205/269; 205/271; 205/291; 205/299; 205/305; 205/561; 205/574; 205/575; 205/576; 205/587; 205/588; 205/594; 205/597; 205/598; 205/602; 205/603; 204/237; 204/242; 204/283; 204/284; 204/286

[58] Field of Search ..... 205/98, 101, 291, 205/305, 299, 271, 269, 561, 574, 575, 576, 587, 588, 594, 597, 598, 602, 603; 204/237, 242, 283, 284, 286

[56] References Cited

PUBLICATIONS

Graydon et al., "Suspension Codeposition in Electrowinning Cells: The Role of Hydrodynamics", Can. Chem. Eng., 69 (2), pp. 564–570, 1991.

Mohanta et al., "The Effect of Anodic Bubble Formation on Cathodic Mass Transfer Under Natural Convection Conditions", J. Appl. Electrochem., 7(3), 235–8, 1977.

Graydon et al., "Suspension Codeposition in Electrowinning Cells: The Role of Hydrodynamics", Can. Chem. Eng., 69(2), 564–570, 1991.

"The effect of anodic bubble formation on cathodic mass transfer under natural convection conditions"; Mohanta, S.; Fahidy, T. Z.; J. Appl. Electrochem. 7 (1977) pp. 235–238, which is the underlying publication in Mohanta et al no month available.

"Suspension codeposition in electrowinning cells: the role of hydrodynamics"; Graydon, J. W.; Kirk, D. W.; Can. J. Chem. Eng.; vol. 69; pp. 564–570 (1991) which is the underlying publication in Graydon et al., no month available.

"Ullmann's Encyclopedia of Industrial Chemistry", Fifth, Completely Revised Edition; vol. A9; Dithiocarbamic Acid to Ethanol; Wolfgang Gerhartz et al; 23 pages (no date).

*Primary Examiner*—Kathryn L. Gorgos
*Assistant Examiner*—Edna Wong
*Attorney, Agent, or Firm*—Herbert Dubno

[57] ABSTRACT

An electrolytic cell comprising bipolar electrodes is employed for electrochemical deposition of copper, zinc, lead, nickel or cobalt. An interior space is provided between the cathode side and the anode side of a bipolar electrode. The electrolyte can flow substantially without an obstruction through the interelectrode space between adjacent electrodes. The current densities in the interelectrode space amount to 800 to 8000 A/m$^2$. Gas is evolved on the anode side of the bipolar electrodes and causes liquid to flow along the anode side. In the middle of the height of the anode side that liquid flow has a vertical component having a velocity of 5 to 100 cm/second. Electrolyte solution flows from the upper edge portion of the anode side to a return flow space, in which the solution flows downwardly. From the return flow space the solution is returned to the lower portion of the interelectrode space.

9 Claims, 2 Drawing Sheets

PROCESS FOR THE ELECTROCHEMICAL RECOVERY OF THE METALS COPPER, ZINC, LEAD, NICKEL OR COBALT

FIELD OF THE INVENTION

Our present invention relates to a process for the electrochemical deposition of copper, zinc, lead, nickel or cobalt from an aqueous electrolyte. More particularly, the invention relates to a process for recovering one of the metals from a solution in which the metal is contained in an inogenic form and in which the solution is passed through an electrolytic cell comprising vertically extending bipolar electrodes, which are electrically connected in series, wherein each of the bipolar electrodes has a cathode side and an anode side, the metal is deposited on the cathode side and the electrolytic cell comprises a terminal anode that is connected to positive pole and a terminal cathode connected to the negative pole of a d.c. source.

BACKGROUND OF THE INVENTION

A process for the electrochemical winning of metal is described in U.S. Pat. No. 5,248,398. The bipolar electrodes used in that process consist of simple plates, which may be composed of two layers. The current densities in the electrolytic cell are in the range from 1 to 27 amperes per square meter ($A/m^2$).

OBJECT OF THE INVENTION

It is an object of the invention to provide an improved process of the type described with an increased deposition rate and reduced operating costs.

SUMMARY OF THE INVENTION

This object of the invention is accomplished in accordance with the invention in that an electrically conductive connection is provided by at least one metal web between the cathode side and the anode side of at least one of the bipolar electrodes, the electrolyte solution is caused to flow substantially without obstruction through the interior space between the cathode side and the anode side of each electrode and the interelectrode space between adjacent electrodes, current densities in the range from 800 to 8000 $A/m^2$ are maintained in the interelectrode space, gas is evolved in the interelectrode space on the anode side of the bipolar electrode or electrodes, the rising gas flow is discharged from the electrolytic cell and induces along the anode side a liquid flow which in the middle of the height of the anode side has a vertical component having a velocity of flow from 5 to 100 cm/second, and electrolyte is conducted from a region at the top edge of the anode side to a return flow space, in which the solution flows downwardly and from which the solution is returned to the lower region of the interelectrode space.

More particularly the process comprises the steps of:

(A) disposing a plurality of vertical bipolar electrodes in an electrolytic cell containing the electrolyte so that each of the bipolar electrodes has a cathode side on which metal is deposited and an anode side, the bipolar electrodes are disposed between a terminal cathode connected to a negative pole of a direct current source and a terminal anode connected to a positive pole of the source;

(B) electrically connecting each cathode side of each bipolar electrode to the respective anode side with at least one metal web;

(C) inducing flow of the electrolyte without obstruction through an interior space between cathode and anode sides of each bipolar electrode and through interelectrode spaces between the bipolar electrodes;

(D) maintaining a current density of 800 to 8,000 $A/m^2$ in the interelectrode spaces;

(E) evolving gas in the interelectrode spaces to produce a rising gas flow inducing along the anode sides a liquid flow with a vertical component of velocity of 5 to 100 cm/second at a middle of a height of the respective anode sides;

(F) discharging rising gas from the cell above the electrolyte therein; and (G) conducting electrolyte rising in the interelectrode spaces at top edges of the anode sides to return flow spaces and then downwardly in the return flow spaces to bottoms of the interelectrode spaces.

In the process in accordance with the invention the electrolyte is vertically circulated, the force for moving the liquid is derived from the lifting force of the gas bubbles which have been formed and an external pump is not required. As a result, the formation of an excessively depleted boundary layer in the electrolyte on the anode side by the gas bubbles forming there will be prevented. At the same time, a relatively high metal ion content is thus achieved even at the upper portion of the electrodes, i.e., at the upper region of the cathode sides. In the process in accordance with the invention the gas bubbles are discharged quickly by the circulation of the electrolyte and fresh electrolyte is supplied as quickly as possible. As a result, the electrolytic cell can be operated at high current densities because even an increased evolution of gas can be controlled.

The process in accordance with the invention serves for the electrolytic recovery of metals from a solution and can mainly employ electrolytes obtained by the leaching of oxide ores or consisting of spent pickles. Details of such metal-winning processes are described in Ullmann's Encyclopedia of Industrial Chemistry, 5th edition, Volume A 9, pages 197 to 217.

To produce in the electrolytic cell an intense vertical electrolyte flow on the anode sides of the electrodes, the electrolyte must be offered a return flow space in which the electrolyte can flow down substantially without obstruction. That return flow space should be free from gas bubbles at least to such a degree that the downward movement of the liquid will not appreciably be obstructed.

The return flow space may be provided in various ways. In one embodiment an electrode-free side chamber is formed in a double side wall of the electrolytic cell and the electrolyte can enter that side chamber at its top and can leave the side chamber at its bottom. Advantageously one such side chamber is provided in each of the opposite side walls of the electrolytic cell. In another embodiment a return flow space is provided in the interior of each electrode.

In the process according to the invention the electrolytic cell can be supplied with an electrolyte which has previously been warmed up so that the temperature in the cell lies in the range from 30° to 80° C. and preferably is at least 35° C. In the selection of the height and width of the bipolar electrodes the width measured in the horizontal direction can freely be selected within a wide range. The height of the cathode side and the anode side (measured in the vertical direction) suitably amounts to 0.5 to 3 meters and preferably to at least one meter so that the vertical movement of liquid along the anode side can fully be developed. It also is advantageous to entirely immerse particularly the anode side of the bipolar electrodes in the electrolyte so that the electrolyte can rise on the anode side without an obstruction.

Copper is usually deposited from a copper sulfate solution and in that case the copper content of the fresh electrolyte usually amounts to 20 to 100 grams per iter (g/l). The content of acid ($H_2SO_4$) in the electrolyte is in the range from about 100 to 200 g/l. Similar considerations are applicable to zinc, nickel, and the other metals. Lead is preferably deposited from a solution in which the acid is $H_2SiF_6$. The voltage between adjacent bipolar electrodes is in the range from 1.5 to 5 volts and usually is at lest 2 volts.

In the process in accordance with the invention current densities in the range from 800 to 8000 A/m$^2$ and preferably of at least 1500 A/m$^2$ are maintained in the interelectrode space between adjacent electrodes. In practice those current densities may preferably lie in the range from 2000 to 8000 A/m$^2$. Owing to the evolution of gas on the anode side of the electrodes the velocity of flow of the electrolyte has vertical components of 5 to 100 cm/second and usually of at least 20 cm/second in the middle of the height of the anode side. This shows that an intense vertical circulation of electrolyte is effected in the process in accordance with the invention at each bipolar electrode.

To minimize the electrical resistance of the electrolyte, the bipolar electrodes are so arranged that the interelectrode space has a relatively small width. The width of the interelectrode space is the distance between adjacent bipolar electrodes and lies in the range from 20 to 40 mm. It has also been found that the use of interelectrode spaces having a smaller width will result in a higher velocity of the rising gas so that the convection of the electrolyte will be accelerated. If the convection of the electrolyte is good, it is possible to supply a fresh electrolyte having a low metal ion concentration. This is desirable because the viscosity of the electrolyte is relatively low.

The desired metal is deposited on the cathode side of the bipolar electrode. That cathode side usually consists of a sheet of metal, such as titanium.

The anode side may also consist of a metal sheet and should have a surface area which is as large as possible. This may preferably be provided by the use of a perforated sheet, a grid, a metal net, or expanded metal. The anode side may also consist of titanium, which may be activated in known manner by a coating, e.g. of platinum or iridium. The electrolyte has usually a pH in the range of 0 to 2.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
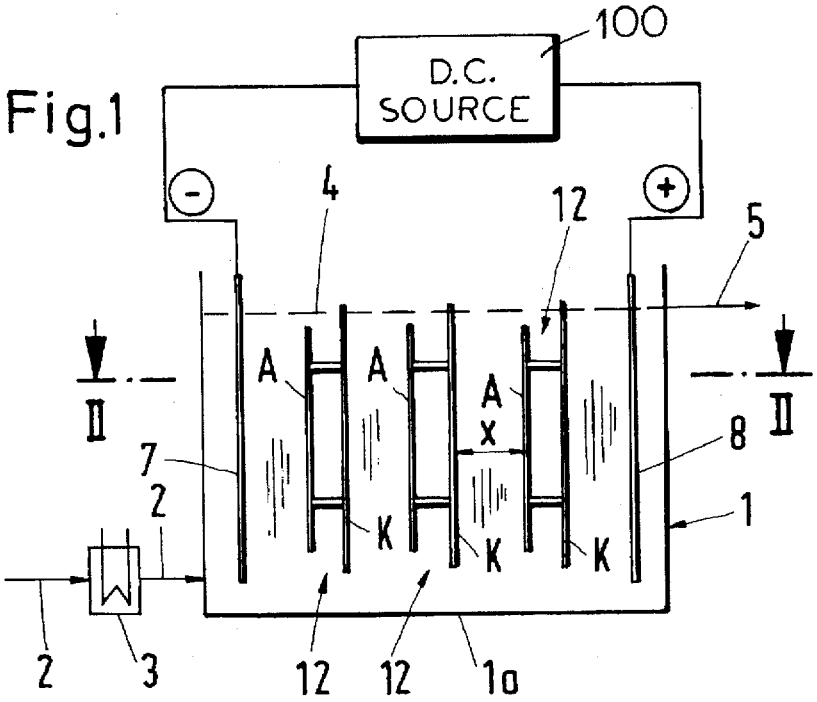
FIG. 1 is a schematic vertical sectional view showing an electrolytic cell.

FIG. 1 is a schematic illustration showing the open-topped vessel 1 of the electrolytic cell. That vessel 1 has a bottom 1*a*. The electrolyte is supplied through line 2 comprising a heat exchanger 3 by which the electrolyte is kept at the desired temperature. The electrolytic cell 1 is filled with electrolyte to the liquid level 4 indicated by a broken line. Spent electrolyte is drained through a line 5.

The cell 1 contains three bipolar electrodes 12 as well as a terminal cathode 7 and a terminal anode 8, which are respectively connected to the negative and positive poles of a d.c. source 100. The bipolar electrodes are not provided with electric terminals but are supplied with electric current owing to the electrical conductivity of the electrolyte and are so disposed between the terminal anode 8 and the terminal cathode 7 that they are electrically connected in series.

Figure 2:
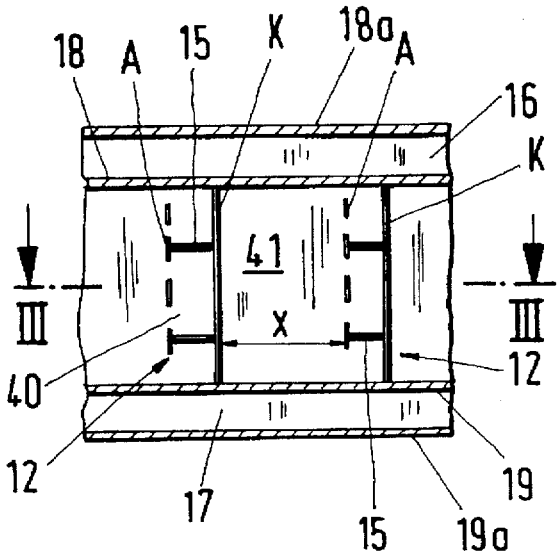
FIG. 2 is a horizontal sectional view taken along line II—II in FIG. 1 and showing a first embodiment of the electrolytic cell.
Figure 3:
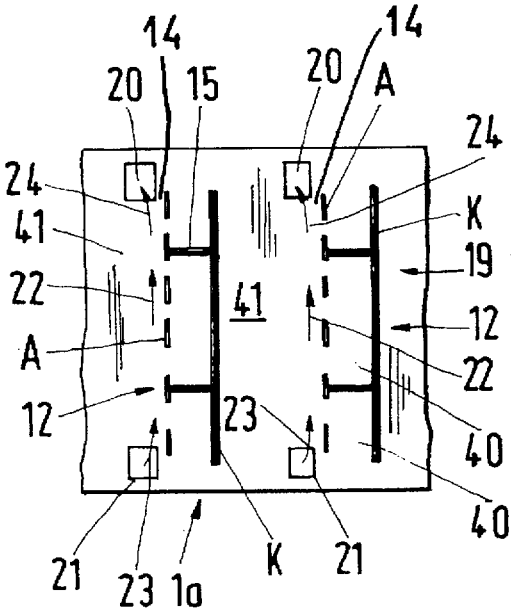
FIG. 3 is a vertical sectional view taken along line III—III in FIG. 2.

As is apparent from FIGS. 1 to 3, each bipolar electrode 12 comprises a sheetlike cathode side K and at a distance from the cathode side K a sheetlike anode side A. The cathode side and anode side are interconnected by electrically conductive metal webs 15 or by different electrical conductors, such as tongue-shaped strips. The space between the anode side A and the cathode side K of each bipolar electrode will be described hereinafter as an interior space 40 of the electrode. The space between adjacent electrodes will be described as an interelectrode space 41. The distance between the anode side A and the cathode side K of a bipolar electrode lies usually in the range from 10 to 60 mm. The distance X between adjacent electrodes, i.e. the width of the interelectrode space 41 (see also FIGS. 2 and 3) amounts in most cases to 10 to 60 mm and preferably to 20 to 40 mm.

With reference to FIG. 2 it can be seen that the cell 1 in a first embodiment is provided with two lateral return flow spaces 16 and 17 for the circulating electrolyte. According to FIG. 2, which is a horizontal sectional view showing the cell, the bipolar electrodes 12 are disposed between and are detachably secured to the two vertical side walls 18 and 19. Each of said side walls is associated with a parallel outer wall 18*a* and 19*a* to define lateral chambers, which serve as return flow spaces 16 and 17.

FIG. 3 is a vertical sectional view that is taken on line III—III on the inside surface of the side wall 19, which is provided near its top with openings 20 and near its bottom with openings 21. Owing to the violent evolution of gas on the anode side A the liquid is lifted close to the anode side by the pump action of the gas bubbles as is indicated by the arrows 22. Electrolyte liquid is sucked at the same time from the return flow space 17 through the openings 21 into the interelectrode space 41, as is indicated by the arrows 23. From the upper portion of the anode side A (see FIG. 3) the electrolyte finally flows through the openings 20 into the return flow chamber 17 (arrows 24) and flows downwardly therein to complete the vertical circulation of the electrolyte. Any gas, such as oxygen, which may be formed can escape upward. By that circulation of electrolyte the undesired coverage of the anode side by gas bubbles is greatly reduced so that voltage drops in that region will be reduced and the capacity of the cell as a whole will be improved. The electrolyte is circulated without a need for an external pump.

In accordance with FIG. 3 the side wall 19 has for each bipolar electrode 12 only one upper opening 20 and one lower opening 21, although a plurality of upper openings and a plurality of lower openings may be provided adjacent to each electrode in a modified embodiment. The explanations given for the side wall 19 are also applicable to the vertical side wall 18 (FIG. 2), which is also formed with openings.

Care is taken that the vertical component of the liquid flow has a velocity of flow of 5 to 100 cm/second and preferably of at least 20 cm/second in the middle of the height of the anode side A. That vertical component is indicated in FIG. 3 by arrows 22.

Figure 4:
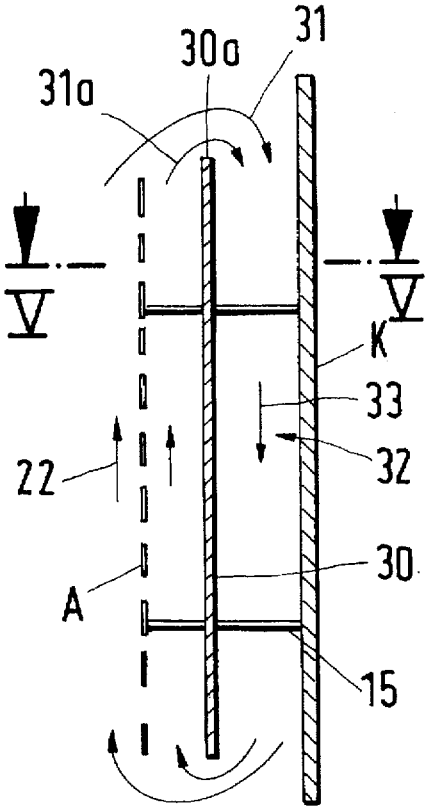
FIG. 4 is a vertical sectional view taken along line IV—IV in FIG. 5 and showing a bipolar electrode and an associated return flow space.
Figure 5:
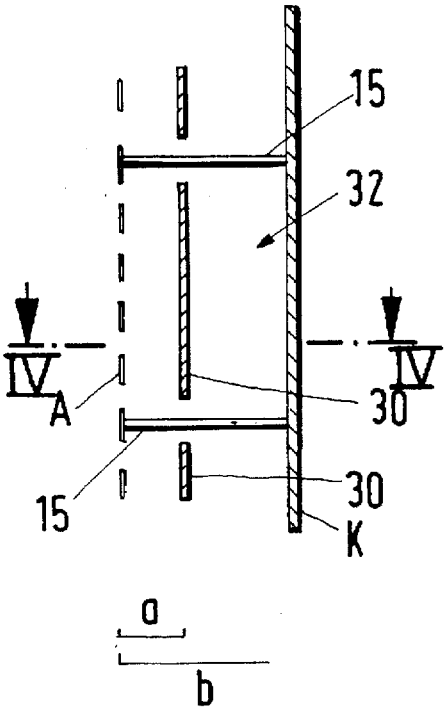
FIG. 5 is a horizontal sectional view taken along line V—V in FIG. 4.

With reference to FIGS. 4 and 5 it will be explained that the double outer walls of the electrolytic cell, which outer walls are designated 18*a* and 19*a* in FIG. 2, may be omitted and a return flow space may be provided within each bipolar electrode. The cathode side K is again connected by electrically conductive metal webs 15 to the anode side A. A vertical partition 30 made of an electrically non-conductive material, such as polymethyl methacrylate resin, polypropylene, polyester or polyvinylchloride, is provided between the cathode side K and the anode side 1. The distance a between the anode side A and the partition 30 is usually 0.01 to 0.4 times the distance b between the anode side A and the cathode side K (see FIG. 5).

Owing to the partition 30 the electrolyte which has been lifted by the gas bubbles evolved on the anode side A can enter over the top edge 30*a* of the partition 30 the return flow space 32 on the path which is indicated by the arrow 31. Because gas bubbles are evolved on both sides of the anode side, liquid flows into the return flow space 22 also from the region between the anode side A and the partition 30, as is indicated by the curved arrow 31*a*. In the return flow space 32 the liquid flows down (arrow 33) and then rises from the bottom along the anode side A.

The partition 30 need not be absolutely liquidtight. The desired flow conditions will also be established if the partition 30 has some gaps or interruptions, as is apparent from FIG. 5. Besides, the partition 30 may be entirely omitted and in that case bipolar electrode such as are shown in FIGS. 1 to 3 will be used. In that case the entire interior space 40 of each electrode will be used as a return flow space. In such a bipolar electrode the anode may consist, e.g., of sheet metal.

It is shown in FIGS. 2 to 5 that the anode side A consists of apertured sheet metal and preferably of perforated sheet metal or expanded metal. Alternatively, the sheet metal of the anode side may be free of apertures and in that case the activating coating of the anode side may be provided only on the outside, i.e. on that side which is not in direct contact with the webs 15, so that a violent evolution of gas will take place only on that outside.

Figure 6:
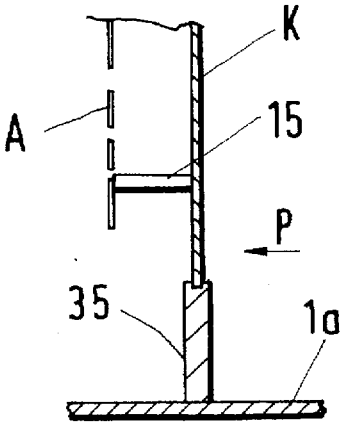
FIG. 6 is a vertical sectional view taken along line VI—VI of FIG. 7 and illustrates a further embodiment of a bipolar electrode provided with a bottom support.
Figure 7:
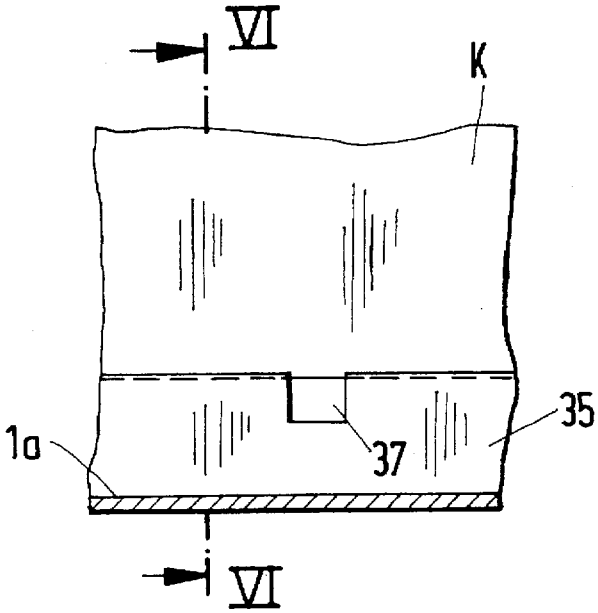
FIG. 7 is an elevational view showing the cathode side of the electrode of FIG. 6 viewed in the direction of the arrow P in FIG. 6.

FIGS. 6 and 7 show supporting bar 35, which is made of an electrically non-conductive material and on which the cathode side K of the bipolar electrode is supported. The supporting bar 35 rises from the bottom 1*a* of the cell and is formed with one opening 37 or with a plurality of such openings, through which the electrolyte can flow. Such a supporting bar may be provided under each electrode and will prevent the occurrence of a short circuit between the electrode by a accumulation of metal-containing sludge on the bottom 1*a* of the cell. The bar 35 serves also to reliably fix the electrode in the cell. The supporting bar usually has a height of 3 to 10 cm.

EXAMPLES

In an experimental plant, electrolytic cells are employed, which are as shown in FIG. 1 and in addition to the terminal cathode and the terminal anode comprise one or more bipolar electrodes as shown in FIGS. 4 and 5. In Examples 1, 4, and 5 no partition 30 is employed. A partition 30 made of polymethyl methacrylate resin and having outside dimensions of 100 cm×50 cm is used in Examples 2 and 3 at a distance of 1 mm from the anode side.

In all cases the interior space of the electrodes is used as a return flow space for the vertical circulation of the electrolyte.

The bipolar electrodes have a cathode side K made of sheet titanium and having a height of 100 cm and a width of 50 cm. The anode side consists of commercially available expanded titanium metal which is coated on the outside with $Ta_2O_5$ and $IrO_2$. The anode side has also a height of 100 cm and a width of 50 cm. In each bipolar electrode the distance between the anode side and the cathode side is 20 mm and the distance X from each bipolar electrode to the adjacent electrode is also 20 mm. For a deposition of copper, an aqueous solution of $CuSO_4$ is used as an electrolyte, which is at the operating temperature. In all examples the vertical component of the velocity of flow of the electrolyte in the middle of the height of the anode side is about 30 to 35 cm/second.

Example 1

The conditions and results of the experiment are stated in Column A of Table 1, in which:

Z=number of bipolar electrodes

Cu=copper content of the electrolyte at the beginning of the experiment $H_2SO_4$=free sulfuric acid content in the electrolyte KL=content of bone glue in the electrolyte S=current density U=voltage between adjacent electrodes T=temperature of electrolyte M=amount of deposited copper A=current efficiency E=energy consumption per 1000 kg of deposited metal

TABLE 1

| | | A | B | C | D | E |
|---|---|---|---|---|---|---|
| Z | | 1 | 1 | 4 | 1 | 1 |
| Cu | (g/l) | 73.4 | 68 | 55 | 63 | 55 = Zn |
| $H_2SO_4$ | (g/l) | 63 | 72 | 95 | 174 | 230 |
| KL | (mg/l) | — | 1 | 3 | — | — |
| S | ($A/m^2$) | 1600 | 1600 | 2000 | 5600 | 1800 |
| U | (Volt) | 3.1 | 2.7 | 3 | 3.6 | 2.73 |
| T | (°C.) | 36 | 50 | 50 | 67 | 40 |
| M | (kg) | 0.94 | 0.87 | 8 | 2.92 | 0.83 |
| A | (%) | 99.5 | 91.8 | 98 | 94 | 80 |
| E | (kWh) | 2770 | 2430 | 2410 | 3250 | 2630 |

The deposited copper is compact and smooth and is uniformly distributed over the cathode side.

Example 2

The conditions and results of the experiment are stated in column B of TABLE 1. In this case too the deposited copper is smooth and compact and uniformly distributed over the cathode side.

Example 3

The conditions and results are stated in column C of TABLE 1. A smooth and uniformly distributed deposit of 2 kg copper is formed on each of the four cathode sides.

Example 4

In this experimental winning of copper the current density is particularly high; see column D of Table 1.

Example 5

In this experiment the electrolyte consists of zinc sulfate and contains 55 g Zn per liter. An aluminum sheet having a thickness of 2 mm was secured to the titanium sheet of the cathode side. The zinc was deposited as a smooth layer on that aluminum sheet.

In all cases the deposited metal layers had the same measured tensile strengths as are usually obtained in known electrolytic processes.

We claim:

1. A process for the electrochemical deposition of a metal selected from the group which consists of copper, zinc, lead, nickel and cobalt present in an ionogenic form in an aqueous electrolyte, said process comprising the steps of:

(A) disposing a plurality of vertical bipolar electrodes in an electrolytic cell containing said electrolyte so that each of the bipolar electrodes has a cathode side on which metal is deposited and an anode side, said cathode side and said anode side of the bipolar electrode disposed 10 to 60 mm apart, the bipolar electrodes are disposed between a terminal cathode connected to a negative pole of a direct current source and a terminal anode connected to a positive pole of said source and in between each of said vertical bipolar electrodes is an interelectrode space;

(B) electrically connecting each cathode side of each bipolar electrode to the respective anode side with at least one metal web;

(C) inducing vertical downward flow of said electrolyte by guiding said downward flow continuously from a top of the cell to a bottom of the cell without obstruction through return flow spaces positioned either in a double side wall of the electrolytic cell or in an interior space between cathode and anode sides of each bipolar electrode or through the interelectrode spaces between said bipolar electrodes;

(D) maintaining a current density of 800 to 8,000 $A/m^2$ in the interelectrode spaces;

(E) controllably evolving gas in the interelectrode spaces to produce a rising gas flow on said anode sides, and a rising liquid flow with a vertical component of velocity of 5 to 100 cm/second at a middle of a height of the respective anode sides;

(F) discharging rising gas from said cell above said electrolyte therein; and (G) conducting electrolyte rising in said interelectrode spaces at top edges of said anode sides to said return flow spaces and then downwardly in said return flow spaces to bottoms of said interelectrode spaces.

2. The process defined in claim 1 wherein the return flow spaces are provided in at least one double side wall of the electrolytic cell.

3. The process defined in claim 1 wherein the return flow spaces are provided in the interior space of at least one bipolar electrode.

4. The process defined in claim 3 wherein the return flow spaces are provided between the cathode side of each bipolar electrode and a partition disposed in the interior space of the respective bipolar electrode.

5. The process defined in claim 1 wherein the anode side consists of a metal sheet which is formed with a plurality of openings.

6. The process defined in claim 1 wherein the cathode side of at least one bipolar electrode is provided on an electrically non-conducting and liquid-permeable support, which extends from the bottom of the electrolytic cell.

7. The process defined in claim 1 wherein the electrolyte in the electrolytic cell is at temperatures in the range from 30° to 80° C.

8. The process defined in claim 1 wherein the anode side of each bipolar electrode has a height of 0.5 to 3 meters.

9. The process defined in claim 1 wherein bipolar electrodes are entirely immersed in the electrolyte in the electrolytic cell.

* * * * *